US009534347B2

(12) United States Patent
Biesbrouck et al.

(10) Patent No.: US 9,534,347 B2
(45) **Date of Patent: *Jan. 3, 2017**

(54) SAFETY STRUCTURE FOR A RAILWAY LINE

(75) Inventors: Gerardus Majella Biesbrouck, Santpoort-Zuid (NL); Johannes Antonius Bakker, Venlo (NL)

(73) Assignee: RSS HOLDING B.V., Venlo (NL)

( * ) Notice: Subject to any disclaimer, the term of this patent is extended or adjusted under 35 U.S.C. 154(b) by 1496 days.

This patent is subject to a terminal disclaimer.

(21) Appl. No.: 13/262,090

(22) PCT Filed: Mar. 29, 2010

(86) PCT No.: PCT/NL2010/050159

§ 371 (c)(1),
(2), (4) Date: Oct. 27, 2011

(87) PCT Pub. No.: WO2010/114367

PCT Pub. Date: Oct. 7, 2010

(65) Prior Publication Data

US 2012/0032128 A1 Feb. 9, 2012

(30) Foreign Application Priority Data

Mar. 30, 2009 (NL) ..... 2002682

(51) Int. Cl.
*E01B 5/18* (2006.01)
*E01B 17/00* (2006.01)
(Continued)

(52) U.S. Cl.
CPC ..... *E01B 26/005* (2013.01); *H01F 7/0252* (2013.01); *Y10T 29/49815* (2015.01)

(58) Field of Classification Search
CPC ..... A01K 3/002; E01B 26/005; H01F 7/0252; Y10T 29/49815; F16B 12/22; F16B 12/34; F16B 12/125; E04G 21/32; E01F 13/00; E01F 13/02; E01F 13/022; E01F 13/024; E01F 13/04; E01F 13/042
(Continued)

(56) References Cited

U.S. PATENT DOCUMENTS 746,985 A * 12/1903 McLaren ..... 256/14
860,010 A * 7/1907 Boswell ..... 238/20
(Continued)

FOREIGN PATENT DOCUMENTS

EP 1355006 A1 * 10/2003
FR 2904836 A * 2/2008
(Continued)

OTHER PUBLICATIONS

International search report dated May 28, 2010 in corresponding PCT/NL2010/114367.

*Primary Examiner* — Gregory Binda
*Assistant Examiner* — Nahid Amiri
(74) *Attorney, Agent, or Firm* — Young & Thompson

(57) ABSTRACT

Safety structure for protecting a railway line includes a fencing on supports resting on the track bed. These supports are connected to a rail of a railway line. The connection is effected by magnetic force. At their free ends, the supports have permanent magnets having a shape allowing them to engage the web of a rail. Due to the significant length of the supports, it is possible to apply a great torque to the magnets when the other end is engaged, that is to say that end which is turned away from the permanent magnets, as a result of which the magnet slides away along the web and can be detached therefrom. The magnet may consist of a number of magnets stacked on top of one another. The magnet is
(Continued)

preferably arranged so as to be slightly displaceable with respect to the support to provide compensation for an uneven surface.

21 Claims, 4 Drawing Sheets

(51) Int. Cl.
*E01B 26/00* (2006.01)
*H01F 7/02* (2006.01)

(58) Field of Classification Search
USPC ..... 256/14, 65.01, 65.02; 29/426.1, 426.5, 29/426.6, 426.4; 238/17–23; 403/DIG. 1
See application file for complete search history.

(56) References Cited

U.S. PATENT DOCUMENTS 1,332,451 A * 3/1920 Wells ..... 246/245
1,335,350 A * 3/1920 Pope ..... 49/273
1,476,598 A * 12/1923 Dandridge et al. ..... 238/10 R
2,533,768 A * 12/1950 Conrad ..... 246/210
3,897,928 A * 8/1975 Eisler ..... 249/78
4,543,584 A * 9/1985 Leer ..... 343/881
4,666,362 A * 5/1987 Landsberger et al. ..... 414/735
4,982,684 A * 1/1991 Rubey ..... 116/203
5,040,452 A * 8/1991 Van Kerkvoort ..... 92/50
5,188,342 A * 2/1993 Ouellette et al. ..... 256/65.08
5,269,623 A * 12/1993 Hanson ..... 404/6
5,714,063 A * 2/1998 Brunsting ..... 210/222
6,443,363 B1 * 9/2002 Fasano ..... 238/336
6,942,199 B2 * 9/2005 Higgs et al. ..... 256/65.14
7,278,731 B2 * 10/2007 Madison ..... 351/47

FOREIGN PATENT DOCUMENTS

FR 2904836 A1 * 2/2008 ..... E01B 26/005
GB 888285 A * 1/1962
GB 2333795 A * 8/1999
NL 1 030 956 7/2007
WO 2007/035085 3/2007

* cited by examiner

SAFETY STRUCTURE FOR A RAILWAY LINE

BACKGROUND OF THE INVENTION

Field of the Invention

The present invention relates to a safety structure for protecting a construction including a rail extending along the construction.

Description of the Related Art

A structure of this type is generally known in the state of the art. Examples which may be mentioned include FR 2,904,836, NL 1,030,956 and GB 2,333,795. All these structures are configured to connect the support to a rail of the railway track which is still present, due to the fact that when work is being carried out on double or multiple tracks, one railway track will generally be worked on while the other railway track will remain in use. Therefore, the railway workers will have to be protected. The only fixed points on such a railway track are the rails and sleepers. Therefore, the above-described prior art proposes a structure which engages with the rail foot or the centre sections of the rail, since the head of the rail has to remain clear for any passing trains.

NL 1 030 956 discloses a securing structure for a fence or the like which uses clamps. These clamps engage with the foot of a rail and are provided with a recess to this end. One of the clamps consists of two clamping bodies which are spaced apart and between which a magnet is arranged which comes to lie against the foot, thus locking the clamps.

WO 2007/035085 discloses a completely mechanical clamping system which is clamped between the head, the body and the foot of the rail.

This means that the fitting of such fencing is a complicated matter which takes up a considerable amount of time. The fitting and removal of fencing is a highly critical period because, at those times, the railway workers are not protected, and/or the railway traffic has to be halted completely.

SUMMARY OF THE INVENTION

It is an object of the present invention to provide an improved safety structure which can be fitted and removed in a quick and simple manner. In addition, it is an object of the present invention to provide a safety structure which can be used under all kinds of circumstances, that is to say both with structures using sleepers on a gravel bed and other kinds of structures (for example those where the sleepers are (partly) cast in or attached to a concrete slab).

According to the present invention, magnetic force is used to attach the fencing to the respective rail. Nowadays, the permanent magnets which are commercially available are so strong that magnetic force can withstand the loads which are exerted on the fencing. These loads are mainly wind loads, either caused by storms or by passing trains. Such loads act in a direction at right angles to the web of the rail, that is to say in a direction substantially parallel to the longitudinal direction of the supports for the fencing. Surprisingly, it was found that even rail sections with small dimensions have sufficient (magnetic) inductance to ensure secure attachment.

The magnetic connection between the rail and the support takes place near the web. The web or centre section of a rail offers a relatively large engagement surface for, for example, a permanent magnet.

According to the present invention, tensile force on the support, that is to say a force in the direction of moving the support away from the rail is (preferably substantially completely) absorbed by the magnet. This is in contrast with prior-art structures in which such a tensile force is absorbed by hooks situated on the opposite side of the rail.

This means that removal of the magnet and thus of the support of the rail is not possible by simply pulling thereon, that is to say applying a tensile force on the support in a direction at right angles to the longitudinal extension of the web. However, it is possible to release the connection between the support and the rail in a simple manner by tilting the end of the support upwards, away from the rail. Such a tilting movement will cause the magnet to move along the web and subsequently along the foot of the rail and will then cause the connection between the rail and the permanent magnet to be released by a sliding movement. This type of disconnection by a sliding movement can be achieved in a relatively simple manner. In addition, the support has a considerable length, so that the application of a force near its free end results in a significant torque being applied to the rail.

According to an advantageous embodiment of the invention, the magnet is composed of a number of magnet sections arranged above or next to one another. These may adjoin one another directly, but it is also possible to provide separate bodies therebetween, such as plastic material filled with magnetic material.

Preferably, the polarity of these magnet sections alternates, that is to say, viewed in the direction of the web of the rail, a succession of north/south/north/south/north/south or the other way round is produced. As a result thereof, the extent of the magnetic field in the rail is limited so that the transmission of other electromagnetic signals in or near the rail is disturbed as little as possible.

According to a further advantageous embodiment, the magnet can be displaced slightly with respect to the support. This displacement is relatively small, but makes it possible to compensate for differences in height resulting from inaccuracies, such as for example differences in height due to the presence of the gravel bed. According to a further embodiment, with the structure which is fitted with a number of magnet sections, these magnet sections can also be displaced with respect to one another. This is preferably achieved by means of a fork-like part in which said magnet or magnet sections are accommodated.

According to a further advantageous embodiment, the supports are hingedly connected to one another by means of posts. Pipes are in turn attached to these posts, thus forming the fencing. These posts can be folded in with the supports, producing a compact structure which can easily be removed and transported.

According to a particular embodiment of the present invention, the head end part comprising the magnet (magnet sections) is the only part of the support which is in contact with the rail. According to a particular embodiment of the present invention, the support is designed such that it can rest on a sleeper. By resting the support in this way, it can be ensured in the case of a series of supports that these are always exactly at the same level, as a result of which the fencing can be accurately adjusted. This prevents any irregularities in the gravel bed from causing an irregular positioning of the fencing.

The invention also relates to a method for removing a safety structure for protecting a railway line, which safety structure comprises a fencing which is upright in the position of use and provided with supports which are horizontal in the position of use, which supports can be connected to a rail by one end, said end of said supports comprising a head end part with a permanent magnet, a free contact surface of which is in contact with the web of a rail, in which the support is lifted at the end near the fencing, the magnet is pushed downwards along the web of a rail and is detached from said web.

In addition, the invention relates to a railway provided with a safety structure, comprising a railway track constructed on a bed and consisting of sleepers and spaced-apart rails, wherein each rail comprises a head, web and foot, in which the safety structure comprises a fencing which is upright in the position of use and provided with supports which are approximately horizontal in the position of use, which supports can be connected to one of said rails by one end, said end of said support comprising a permanent magnet, a free contact surface of which is in contact with the web of said rail.

BRIEF DESCRIPTION OF THE DRAWING FIGURES

The invention will be described in more detail below with reference to an exemplary embodiment illustrated in the drawing, in which.

DETAILED DESCRIPTION OF THE INVENTION

Figure 1:
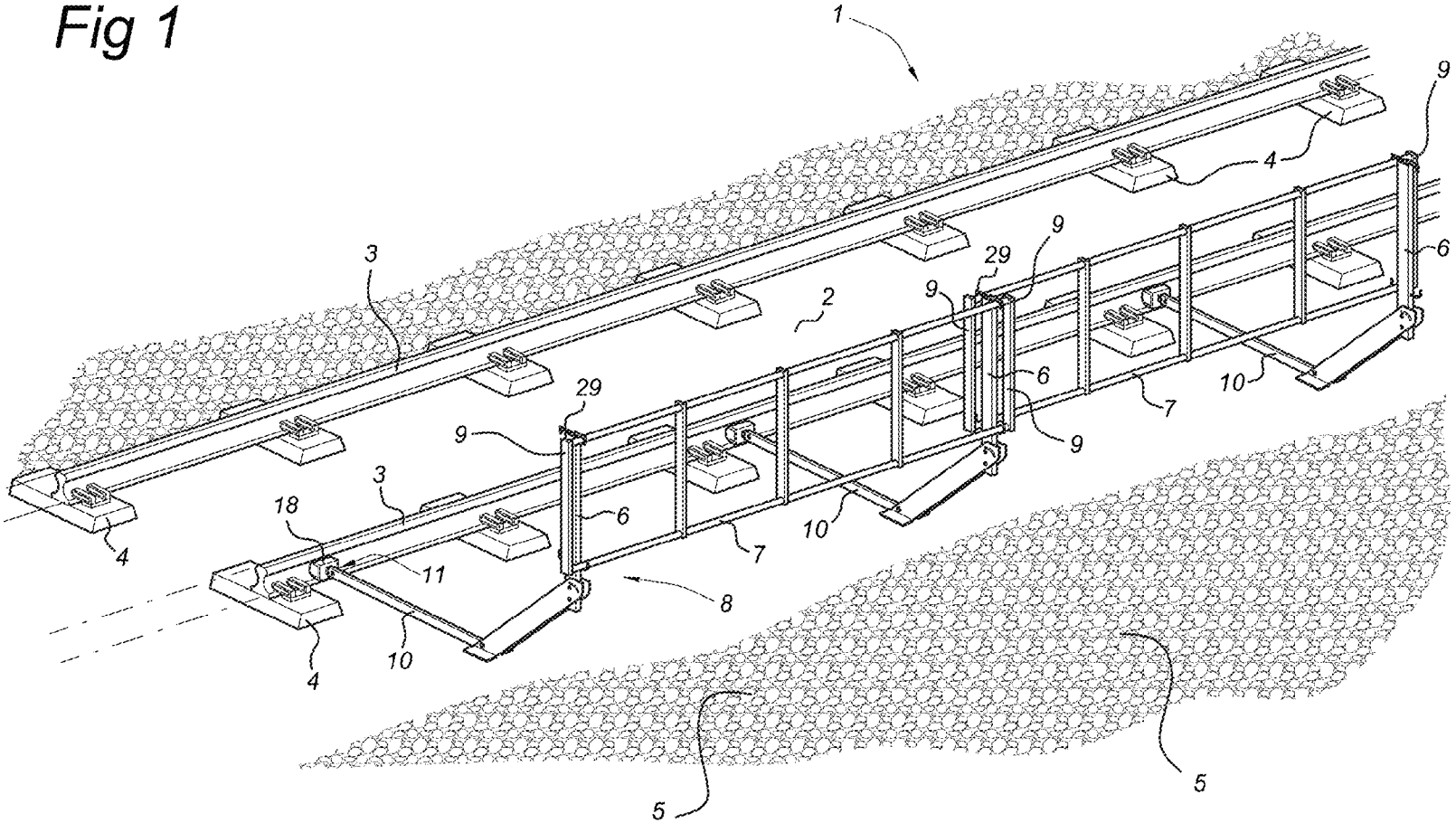
FIG. 1 shows a railway line provided with the safety structure according to the invention.

FIG. 1 shows a railway line consisting of a railway track 1 on which no work is being carried out. This railway track 1 comprises a bed 2 with two spaced-apart rails 3 arranged thereon which are connected to one another via sleepers 4. Reference numeral 5 denotes the zone situated next to the railway track 1. This may be a road or another civilian structure, but will generally be a further railway track, with maintenance having to be carried out on said railway track 5 (not shown). Rail 3 consists of a head 24, web 25 and foot 26.

Figure 2:
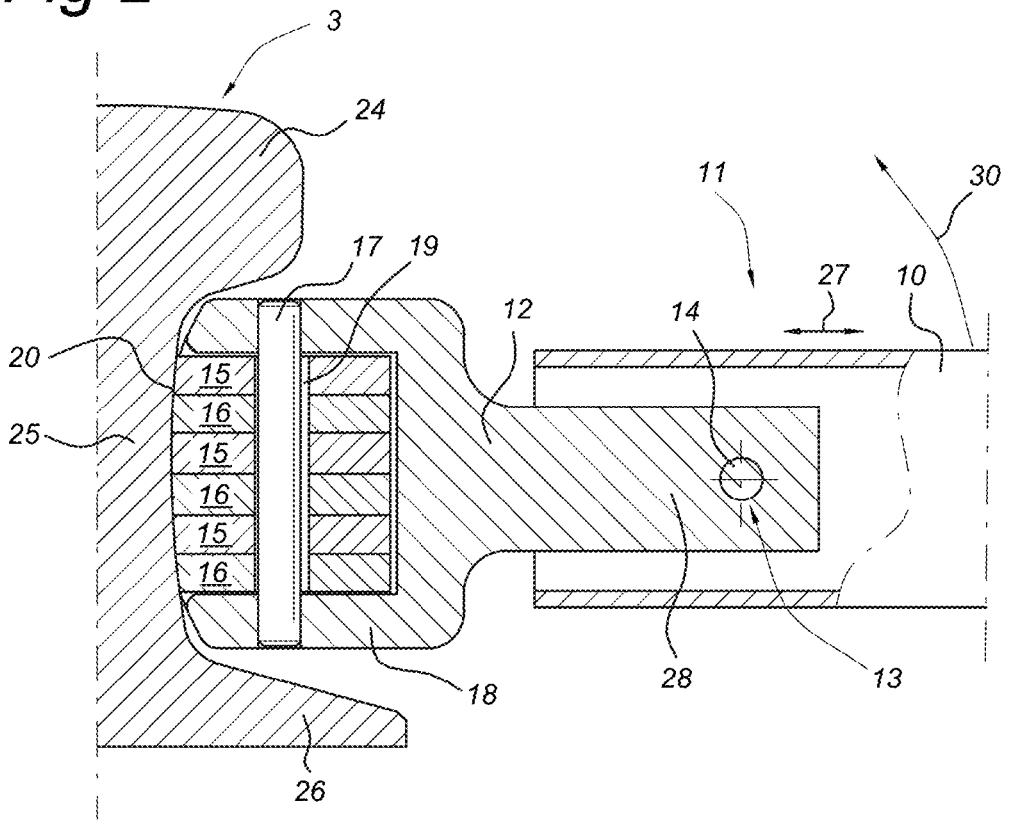
FIG. 2 shows a partial cross section in side view of a detail of the safety structure.

If the railway track 1 remains in use, the safety of the workers must be ensured under all circumstances. To this end, a fencing 9 consisting of longitudinal pipes 7 coupled to posts 6 is provided to form the fencing 9. The posts 6 are connected to supports 10 by means of hinges 22 and 23 which are to be described below with reference to FIGS. 4 and 5. The supports 10 are attached to the web 25 of rail 3 by means of permanent magnets, as can be seen in FIG. 2. FIG. 2 shows how the end 11 of support 10 is provided with a fork-like part 12 near the rail 3. The stem 28 of this fork-like part is hingedly connected to support 10 via hinge 13 which comprises a hinge pin 14. When fitted correctly, the centre axis of this hinge pin extends substantially parallel to the longitudinal axis of rail 3. Adjoining the stem 28 is a head 18 which has a recess for accommodating a number of magnets 15 therein. Viewed in the fitted position, the assembly which is thus formed is at least 5 cm and more particularly approximately 7 cm high and at least 10 cm and more particularly approximately 20 cm long. As a result of the large contact surface, it is possible to achieve a sufficiently strong "force of adhesion" to the rail using relatively inexpensive magnets. The head 18 is made of an electrically insulating material in order to ensure complete electrical insulation of the rail and the safety barriers. This makes it possible to prevent possible ground loops. Signal currents pass through the rail which could be disturbed by ground loops. The magnets 15 are in each case separated by an intermediate disc 16 which may, for example, consist of a plastic material filled with metal. In this case, it is possible for the front surfaces 20 of all magnets to have the same polarity. However, it is also possible to arrange these alternately north/south. The magnets and preferably also the parts 16 are provided with an opening 19 which is greater than the opening of a pin 17 which is arranged in the head 18. As is illustrated, this pin extends substantially vertically. As a result thereof, the various magnet sections 15 can remain in contact with the web 25 of the rail 3 even if the structure 12 is tilted slightly.

As can be seen in the drawing, the free surface 20 of the magnets 15 is embodied such that it corresponds as much as possible to the shape of the web 25.

Figure 3:
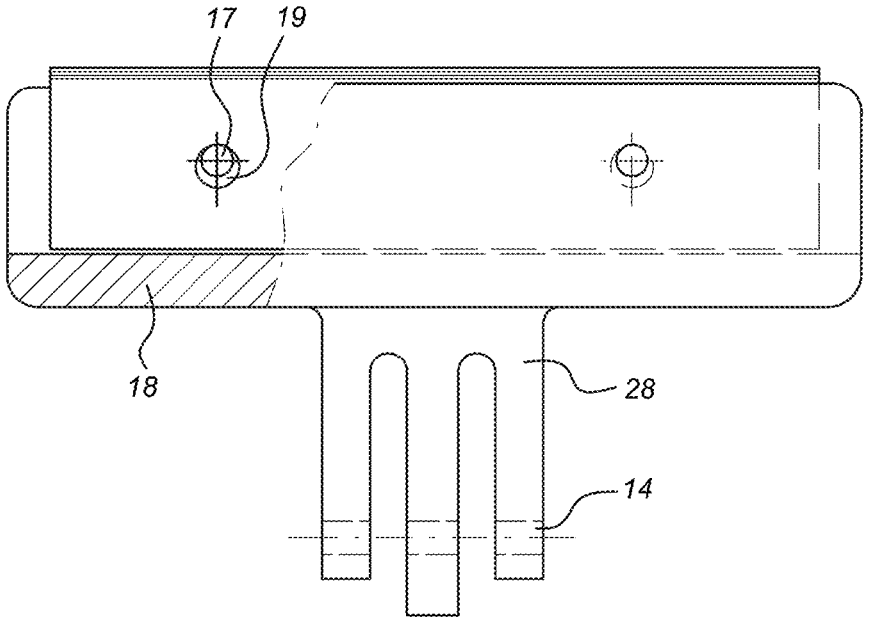
FIG. 3 shows a top view of the detail from FIG. 2.

FIG. 3 shows further details of the way the fork structure 12 is attached to the support 10.

Figure 4:
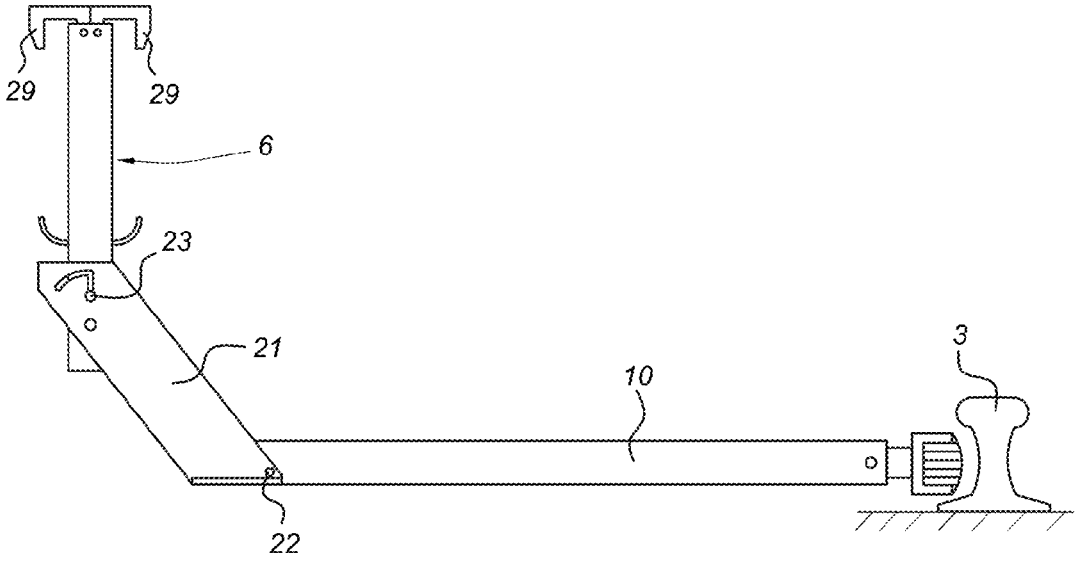
FIG. 4 shows a side view of the combination of the support and post in the folded-out position.
Figure 5:
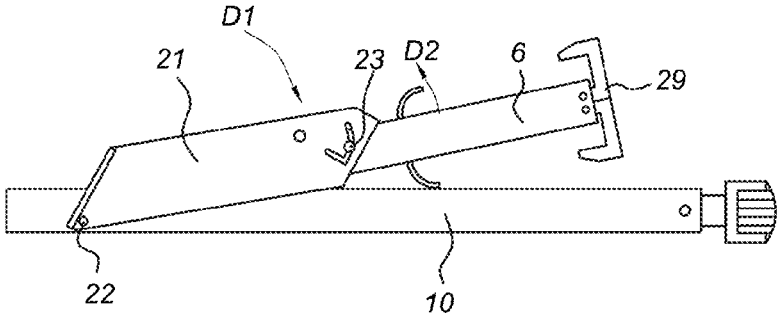
FIG. 5 shows the combination from FIG. 4 in the folded-in position.

FIG. 4 diagrammatically shows the support 10 which is connected to post 6 via hinge 22, connecting piece 21 and hinge 23. These hinges 22 and 23 form a folding structure, as can be seen from FIG. 5. It is possible to connect the pipes 7 (FIG. 1) which may be connected to one another in any possible way to the support 10 in any way which can be conceived of in the state of the art. Thus, a locking structure 29 may be used for this purpose which locks automatically and requires a separate operation in order for it to be unlocked.

It will be understood that the structure illustrated above can be fitted in a very simple manner, since the free end 11 of the supports can readily be placed against the web 25 of the respective rail, which immediately results in a connection. Subsequently, when a number of supports 10 has been fitted, the fencing can immediately be attached thereto, thus keeping the "unsafe" period relatively limited.

In order to remove the structure, the fencing 9 has to be removed first. Depending on the structure which has been used to attach the longitudinal pipes 7 to the posts 6, any prior art operation can be used for this purpose. Thereafter, the individual supports of the rail 3 have to be removed. This can be done in a simple manner by lifting the end of the supports 10 near the post 6. According to a particular embodiment, it is even possible to fold out the post 6 in the direction D2 opposite to the direction D1 illustrated in FIG. 5, so that it is more or completely in line with the support 10, resulting in a longer lever.

In all cases, it is possible to apply a significant torque to the end 11 of support 10 using this lever. As a result thereof, the fork-like structure as illustrated in FIG. 2 will tilt to the left and the magnets 15 will slide along the web 25 in the direction of the foot 26. As the foot 26 does not have a shape which corresponds to the shape of the front surfaces 20 of the magnets 15, the magnets will come off gradually at the transition to the foot, as is the case with sliding. This is assisted further by the fact that the top side of the head 18 touches the bottom side of the head 24 when the support 10 is moved upwards in the direction of the arrow 30.

In this manner, a single person can very quickly remove each of the supports, while at the same time maintaining a considerable distance to the respective rail even during removal, so that no unsafe situation occurs at that moment.

This is in contrast with the prior art in which screw connections are used and these screw connections have to be attached and/or released at the location of the rail.

Figure 6:
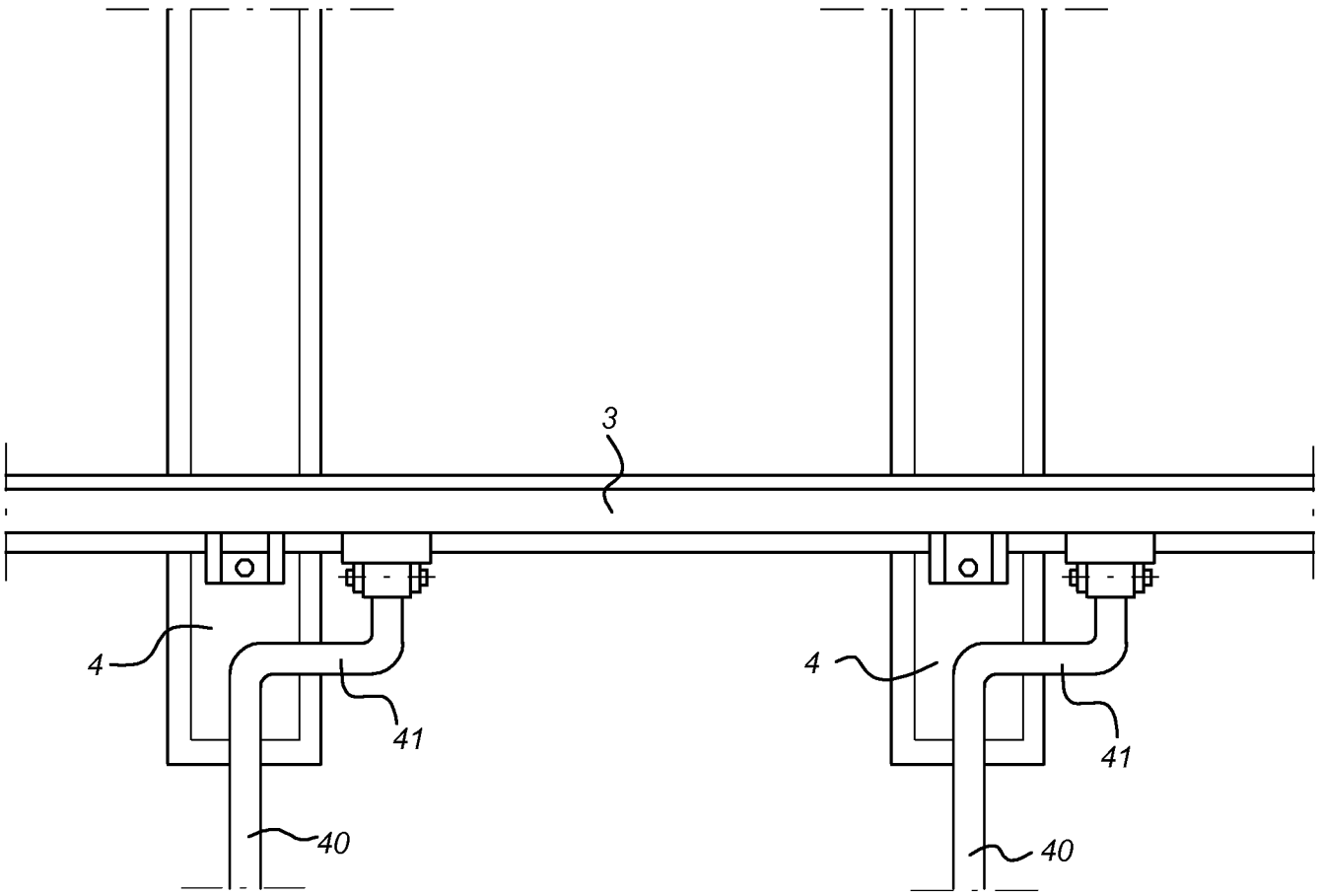
FIG. 6 shows a top view of a variant of the above-described support.

FIG. 6 shows a variant of the above-described structure in top view. In this case, all parts which are identical with parts in the previous embodiments are denoted by the same reference numerals.

In this embodiment, the support is denoted by reference numeral 40 and has an S-shaped bend 41, as can be seen. As a result thereof, that part of the support provided with the head end which engages with the rail can be fitted offset with respect to the sleeper, while a further part of the support 40 is supported on the sleeper 4. Supporting it on the sleeper ensures that a series of supports 40 is always situated at the same height, since the sleepers will, viewed in the longitudinal direction, be arranged horizontally at exactly the same level. As a result thereof, it is possible to achieve a correspondingly arranged fencing without requiring additional adjusting operations.

Upon reading the above, those skilled in the art will be able to think of numerous variants which may relate to both the embodiment of the fence and the embodiment of the magnet and the positioning thereof with respect to the rail. Upon reading the above, such structures are obvious and are considered to be within the scope of the attached claims.

The invention claimed is:

1. A safety structure for shielding a construction of a railway track constructed on a bed and consisting of sleepers and spaced-apart rails, in which each rail of the spaced-apart rails comprises a head, web and foot, the safety structure comprising:

a fencing which is upright in a position of use; and supports of the fencing which are horizontal in the position of use, which said supports are adapted to be connected to one of the spaced-apart rails of the construction by one end, said one end comprising a permanent magnet with a free surface for contacting said one rail, said end further comprising a head end part having said magnet, said head end part being embodied to contact a web part of said one rail, a contact surface of said end part comprising the free surface of said magnet, said magnet being provided for absorbing tensile forces exerted in a direction at right angles to said contact surface.

2. The safety structure according to claim 1, wherein said magnet is hingedly connected to a support of said supports.

3. The safety structure according to claim 2, wherein said magnet comprises a number of magnet sections which are situated above one another in the position of use.

4. The safety structure according to claim 1, wherein said magnet comprises a number of magnet sections which are situated above one another in the position of use.

5. The safety structure according to claim 4, wherein said magnet sections are adapted to displace with respect to said support.

6. The safety structure according to claim 5, wherein metal-filled plastic parts are present between said magnet sections.

7. The safety structure according to claim 5, wherein one of the magnet sections is provided with an opening, through which a pin extends, having a substantially smaller diameter than the diameter of said opening is adapted to displace said one of the magnet sections.

8. The safety structure according to claim 5, wherein said magnet sections are adapted to displace with respect to one another in the longitudinal direction of said support.

9. The safety structure according to claim 8, wherein metal-filled plastic parts are present between said magnet sections.

10. The safety structure according to claim 8, wherein one of the magnet sections is provided with an opening, through which a pin extends, having a substantially smaller diameter than the diameter of said opening is adapted to displace said one of the magnet sections.

11. The safety structure according to claim 4, wherein metal-filled plastic parts are present between said magnet sections.

12. The safety structure according to claim 11, wherein one of the magnet sections is provided with an opening, through which a pin extends, having a substantially smaller diameter than the diameter of said opening is adapted to displace said one of the magnet sections.

13. The safety structure according to claim 4, wherein one of the magnet sections is provided with an opening, through which a pin extends, having a substantially smaller diameter than the diameter of said opening is adapted to displace said magnet section.

14. The safety structure according to claim 4, wherein a front surface of said magnet sections corresponds to the shape of the web of said one rail.

15. The safety structure according to claim 1, wherein said magnet is accommodated in a fork part, in which the stem of said fork part is hingedly connected to said support.

16. The safety structure according to claim 1, wherein a support of said supports is attached to said fencing by means of a lockable hinge.

17. The safety structure according to claim 1, wherein said contact surface is at least 5 cm high and 10 cm long.

18. The safety structure according to claim 1, wherein a support of said supports is adapted to be supported on a railway sleeper of the railway track.

19. A method for removing a safety structure for shielding a construction of a railway track constructed on a bed and consisting of sleepers and spaced-apart rails, in which each rail of the rails comprises a head, web and foot, comprising:

providing said safety structure comprising a fencing which is upright in a position of use and provided with supports which are horizontal in the position of use, said supports being connectable to one of the spaced-apart rails by one end, said end of said supports comprising a head end part with a permanent magnet;

contacting a free contact surface of the permanent magnet with a web of said one rail;

lifting an end of a support of said supports near the fencing; and pushing the magnet downwards along the web of said one rail to be detached from said web.

20. A construction provided with a safety structure, the construction of a railway track constructed on a bed and consisting of sleepers and spaced-apart rails, in which each rail of the rails comprises a head, web and foot, wherein the safety structure comprises a fencing which is upright in a position of use and provided with supports which are horizontal in the position of use, which said supports are adapted to connect to one of said spaced-apart rails by one end, said end of a support of said supports comprising a permanent magnet, a free contact surface which is in contact with the web of said one rail.

21. A railway provided with a safety structure, comprising:

a railway track constructed on a bed and comprising sleepers and spaced-apart rails, in which each rail of the rails comprises a head, a web and a foot, wherein the safety structure comprises a fencing which is upright in a position of use and provided with supports, each support being horizontal in the position of use, each support being adapted to connect to one of said spaced-apart rails by one end, said end of each said supports comprising a permanent magnet, and a free contact surface which is in contact with the web of said one rail.

* * * * *